US007911118B2

(12) United States Patent
Rooymans

(10) Patent No.: US 7,911,118 B2
(45) Date of Patent: Mar. 22, 2011

(54) HEAT SINK LAMP AND METHOD FOR MANUFACTURING A HEAT SINK

(75) Inventor: Johannus Otto Rooymans, Ermelo (NL)

(73) Assignee: Lemnis Lighting Patent Holding B.V., Naarden (NL)

( * ) Notice: Subject to any disclaimer, the term of this patent is extended or adjusted under 35 U.S.C. 154(b) by 172 days.

(21) Appl. No.: 11/887,696

(22) PCT Filed: Apr. 3, 2006

(86) PCT No.: PCT/NL2006/050069

§ 371 (c)(1), (2), (4) Date: Mar. 18, 2008

(87) PCT Pub. No.: WO2006/118457

PCT Pub. Date: Nov. 9, 2006

(65) Prior Publication Data

US 2009/0315442 A1 Dec. 24, 2009

(30) Foreign Application Priority Data

Apr. 1, 2005 (NL) ..... 1028678

(51) Int. Cl.
*H01K 1/58* (2006.01)

(52) U.S. Cl. ..... 313/46

(58) Field of Classification Search ..... 313/46, 313/115, 151, 557; 314/26, 27; 315/50; 165/185

See application file for complete search history.

(56) References Cited

U.S. PATENT DOCUMENTS

| | | | | |
|---|---|---|---|---|
| 4,363,083 | A | 12/1982 | Tanaka et al. | |
| 5,561,338 | A * | 10/1996 | Roberts et al. | 313/46 |
| 5,651,609 | A | 7/1997 | Pelton et al. | |
| 5,857,767 | A | 1/1999 | Hochstein et al. | |
| 6,093,064 | A * | 7/2000 | Callen et al. | 439/783 |
| 6,412,971 | B1 * | 7/2002 | Wojnarowski et al. | 362/241 |
| 6,545,427 | B1 | 4/2003 | Vollkommer et al. | |
| 2004/0120156 | A1 | 6/2004 | Ryan | |
| 2005/0201100 | A1 * | 9/2005 | Cassarly et al. | 362/317 |

FOREIGN PATENT DOCUMENTS

| | | | |
|---|---|---|---|
| DE | 20 2004 004570 | U1 | 5/2004 |
| EP | 0114107 | A | 7/1984 |
| JP | 2001 346002 | A | 8/2002 |

* cited by examiner

*Primary Examiner* — Joseph L Williams
*Assistant Examiner* — Brenitra M Lee
(74) *Attorney, Agent, or Firm* — David P. Owen; Coraline J. Haitjema; Hoyng Monegier LLP

(57) ABSTRACT

The invention relates to a heat sink (1) for cooling a light element. The heat sink (1) has a thermally conducting inner part (2) suitable for accommodating the light element. The heat sink (1) additionally has a thermally conducting outer part (3) which encloses the inner part in at least one plane. The at least one light element is galvanically shielded from the thermally conducting inner part. The inner part (2) and the outer part (3) can be joined to one another via at least one thermally conducting bridging link (4) in such a way that there is at least one opening (5) between the inner part (2) and the outer part (3).

16 Claims, 4 Drawing Sheets

HEAT SINK LAMP AND METHOD FOR MANUFACTURING A HEAT SINK

The invention relates to a heat sink for cooling a light element, the heat sink comprising:

a thermally conducting inner part suitable for accommodating the at least one light element;

a thermally conducting outer part that surrounds the inner part in at least one plane.

Cooling of this type is particularly relevant if the life of the light element depends on the temperature during use. The life is shortened at a higher operating temperature. An example of a light element where such a relationship can be found is a light-emitting diode (LED) which has a high luminescence, for example a so-called power LED.

German Utility Model application DE 202004004570 describes alighting means for an illuminating device with a housing in which at least one LED is accommodated. To dissipate the heat, the LED is placed on a cooling section that is connected to the housing. In an embodiment the cooling section is in the form of a cooling pin. The heat is conducted via the cooling pin to the housing and there emitted to the surroundings. Where power LEDs, which can work at a voltage such as that supplied by an electricity network, for example 230 V, are used instead of "normal" LEDs, which operate at a voltage of approximately 12 V, electrical insulation of the housing is not assured. During use, touching the lighting means may lead to electric shocks, which is undesirable.

Japanese patent application JP 2001243809 describes an electric lamp that is provided with a section that is equipped for the emission of heat that is generated by a number of LEDs. The LEDs are mounted on a plate, so that they make good thermal connection therewith, which plate is in turn connected to the heat emission section of the lamp. The generated heat is conducted by the good thermal conduction of the plate to the heat emission section and then emitted to the surroundings by radiation. Although a device of this kind aids heat removal, under certain circumstances this may still be inadequate.

The invention aims to bring about more efficient heat removal, where use of typical network voltages such as 230 V cannot cause electric shocks to a user. In older to achieve this aim, the heat sink according to the invention is characterised in that the at least one light element is galvanically shielded from the thermally conducting inner part. By galvanically shielding the at least one light element from the thermally conducting part, electrical conduction to the outer part is minimised.

In an embodiment at least one of the inner part and the outer part is made of anodised aluminium. This material not only has a low coefficient of electrical conduction, but also has a suitable coefficient of thermal conduction and is additionally relatively easy to machine.

The heat sink preferably has fastening means for fastening to a lamp cap and/or a lamp globe.

In an embodiment, the outer part has a cylindrical structure with a variable diameter and the inner part can be clipped into the outer part. By choosing suitable materials for the inner part and outer part a join can be produced with good heat connection, while both parts are galvanically disconnected.

In an embodiment, the inner part comprises a disc with at least one concentric trough-shaped structure. The concentric trough-shaped structure gives an increase in the radiation surface area of the inner part, as a result of which more heat can be emitted in use.

In an embodiment, the outer part is provided with at least one hole. By means of the at least one hole, a heat flow can be created, owing to the difference in heat between the inner part on the one side and the surrounding air on the other side, which produces extra heat emission.

In another embodiment, the heat sink further comprises at least one thermally conducting bridging link, which joins the inner part and the outer part to one another in such a way that there is at least one opening between the inner part and the outer part. Because of the heat difference between the heat sink on the one side and the surrounding air on the other side, a convection current is created in the at least one opening of the heat sink, which produces extra heat emission.

In a further embodiment thereof, the inner part is a substantially circular disc and the outer part a ring surrounding the inner part. Because of its symmetrical shape this embodiment contributes to even heat removal. Moreover, this shape is extremely suitable for connecting to standard lamp caps.

In a further embodiment, at least one of an outer periphery of the inner parts and an inner periphery of the outer part has a wavy surface pattern. Because of the presence of such a pattern the contact surface between the heat sink and the air present in the opening is enlarged, as a result of which greater heat emission to the convection current is possible.

The inner part, the outer part and the at least one bridging element preferably consist of one piece. This prevents undesired variations in the thermal gradient at the boundaries between different parts and enables simple manufacture, for example with the aid of extrusion.

To promote the heat removal by conduction from the inner part to the outer part, the inner part can be provided with means to promote thermal conduction, for example so-called "heat pipes".

In an embodiment, the bridging element is made of anodised aluminium. This material has a suitable coefficient of thermal conduction, a low coefficient of electrical conduction and is also relatively easy to machine.

The invention further relates to a lamp which, as well as a heat sink according to one of the embodiments, comprises a lamp cap for positioning the lamp and connecting the lamp to an electrical source and at least one light element with a light emission side and a fastening side, the fastening side of the at least one light element being joined to the inner part of the heat sink.

In an embodiment, the at least one light element is a light-emitting diode (LED). So-called power LEDs, that is to say LEDs with a high rating, typically 1-5 watt, are particularly suitable for embodiments of the invention.

In an embodiment, hereof the fastening side of the at least one light element is joined to the inner part of the heat sink via a ceramic layer. The ceramic layer provides for an improvement in the galvanic screening. The ceramic layer preferably has a thickness of 100-500 μm. Suitable ceramic materials include aluminium oxide and aluminium nitride.

The lamp preferably has a transparent protective body which shields the at least one light element on the light emission side of the light element. Such a protective body not only protects the light element, but it also prevents users from receiving electric shocks.

All embodiments of the lamp can be provided on the light emission side of the at least one light element with a light globe. Diffuse light can be obtained with the aid of such a light globe.

The invention further relates to a method for manufacturing a heat sink from a base material, comprising:

providing base material in an enclosed space;

providing an extrusion die with a suitable pattern on one side of the enclosed space;

beating the base material to a predetermined temperature;

extruding the base material by pressing the base material under pressure through the extrusion die so that an extruded elongated object is formed;

subdividing the extruded elongated object into a predetermined size, thereby forming pieces corresponding to the heat sink.

The invention will be further explained below by way of example with reference to the following figures. The figures are not intended to restrict the scope of the invention, but only as an illustration thereof. In the figures.

Figure 4A:
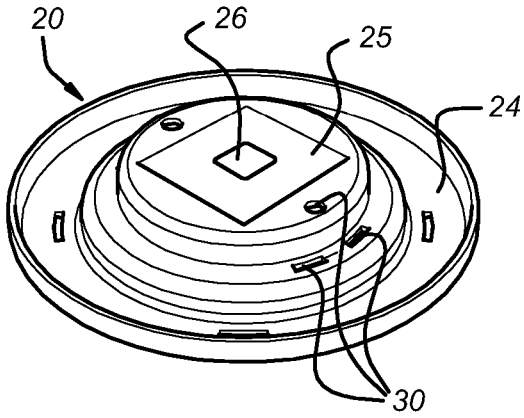
Figure 4B:
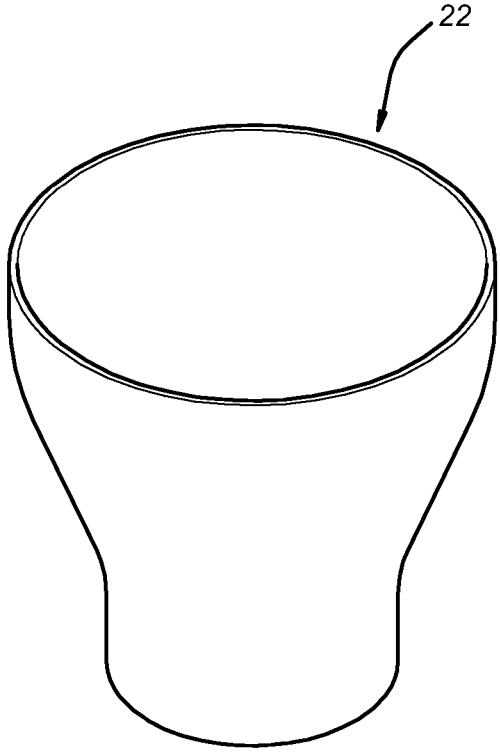
Figure 4C:
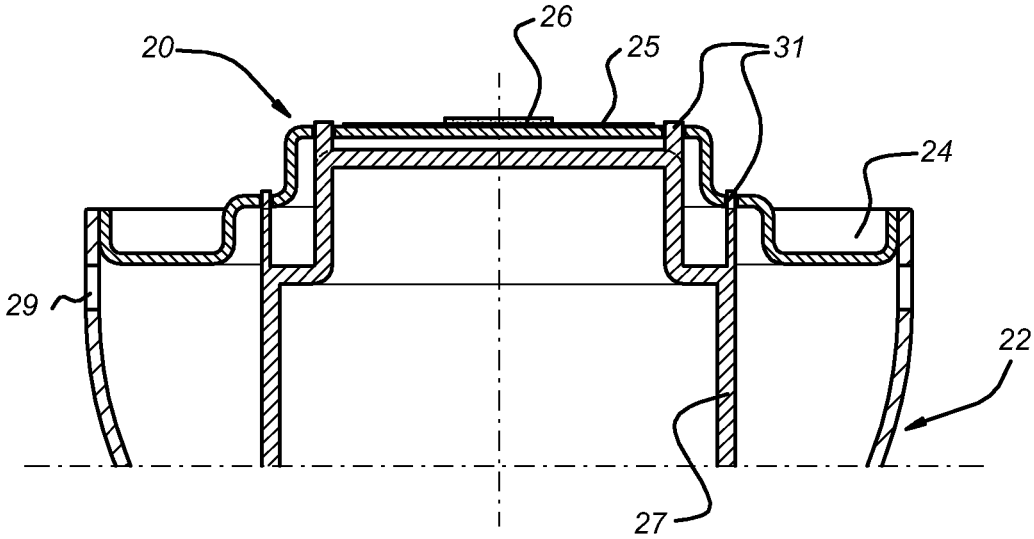

FIGS. 4*a-c* show a third embodiment of a lamp with a heat sink according to the invention.

Figure 1:
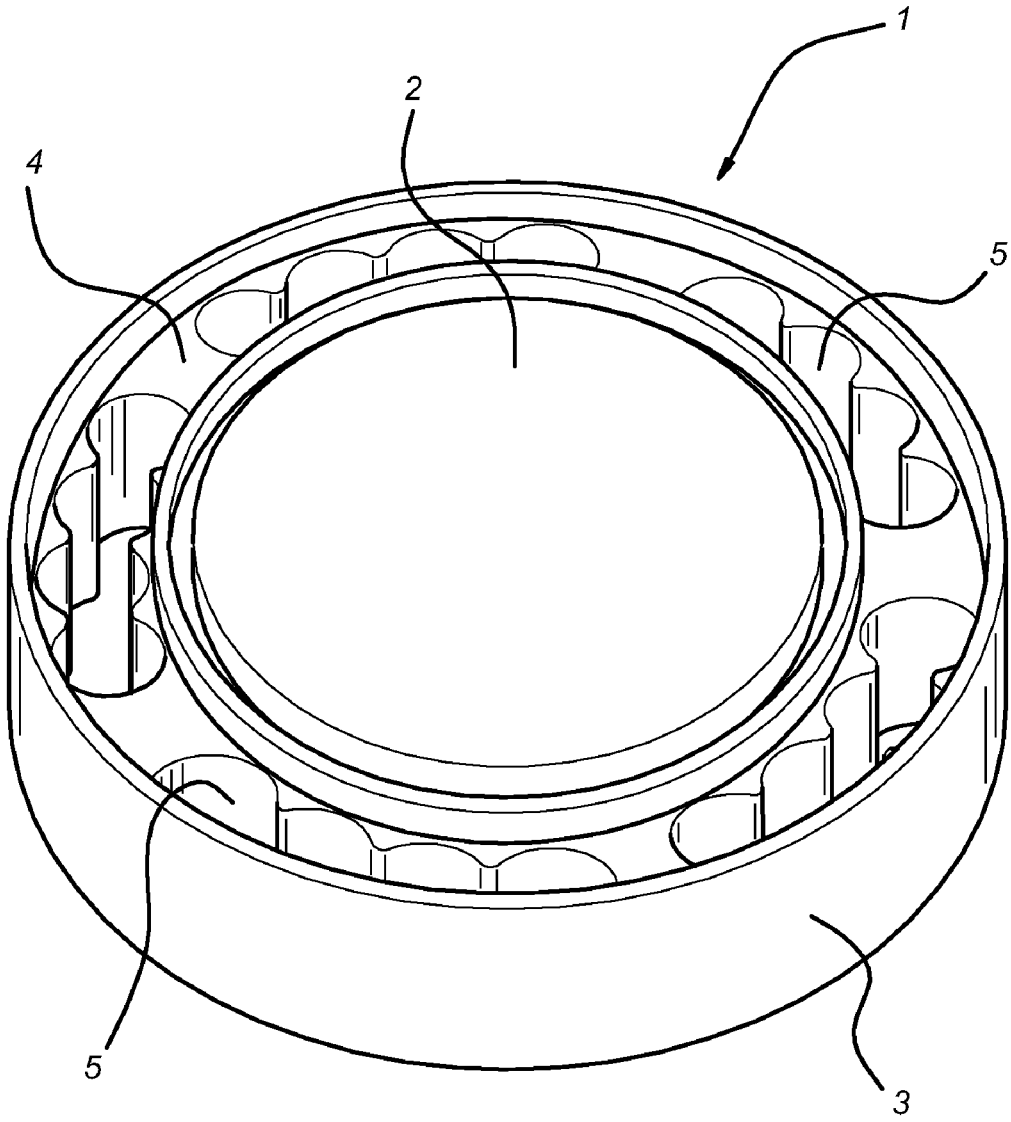
FIG. 1 shows a heat sink according to an embodiment of the invention.

FIG. 1 shows a heat sink 1 according to an embodiment of the invention. The heat sink 1 includes an inner part 2 and an outer part 3, which parts are joined to one another by one or more bridging elements 4. The inner part 2 is equipped to accommodate light elements, such as light-emitting diodes (LEDs) and is preferably somewhat recessed. The light elements can be placed on the inner part 2 in such a way that a good thermal connection is produced between the light element and the inner part, for example by using a suitable thermally conducting fixing compound. The inner part 2 also comprises materials with sufficiently high thermal conduction, such as aluminium. A further improvement in the heat removal by conduction could be attained by using means to promote thermal conduction. For instance, the inner part 2 can be provided with a heat-dispersing film layer, such as described, for example, in U.S. Pat. No. 6,158,502 by Novel Concepts Inc. So-called "heat pipes", mat is to say sealed pipes with a liquid inside which gives rapid thermal conduction, can also be fitted on or in the inner part 2. By employing means to promote thermal conduction, as small a temperature difference as possible between the inner part 2 and the outer part 3 can be achieved, which is of benefit to the speed of the heat removal.

During use, the light element generates a quantity of heat which has to be removed. Because of the good thermal connection between the light element and the inner part and suitable thermal conduction from the inner part 2 to the outer part 3, the heat can be conveyed from the inner part 2 via the one or more bridging elements 4 to the outer part 3 adjacent to the surroundings. The width and the number of the bridging elements 4 depends on the quantity of heat which has to be conveyed to the outer part 3. The heat can be emitted by radiation via the outer part. However, even more occurs. Because of the order of inner part 2, outer part 3 and the one or more bridging elements 4, there are openings 5 between inner part 2 and outer part 3. Because in use the temperature of all the elements 2-4 is higher than the surroundings, the air that is in the one or more openings 5 will warm up. This results in an increasing air flow in the openings 5, which appears to work very well as a convection current. Therefore more heat can be removed than could have been done with radiation alone.

The heat sink 1, as shown FIG. 1, is preferably circularly symmetrical. That is to say, the inner part 2 is a circular disc and the outer part 3 is a ring surrounding the inner part, the centres of the disc and the ring coinciding. By means of this arrangement the heat can be evenly removed and there are as few "hot spots" in the heat sink as possible which could impair efficient cooling.

The outer wall of the inner part 2 and/or the inner wall of the outer part 3 are preferably provided with a wavy pattern, for example in the horizontal direction, as in FIG. 1. The wavy surface pattern gives an increase in the contact surface area between elements 2-4 and the air in the openings 5. As a result of this, even better heat transfer between the elements 2-4 and the air in the openings 5 is achieved. Besides a wavy pattern, it is also possible for other patterns that increase the surface area to be used, for example a rectangular toothed pattern.

All the elements 2-4 are preferably made of the same material. This prevents variations in temperature gradient within the heat sink as a result of material transitions.

A heat sink as shown in FIG. 1 with a height of approx. 15 mm, the outer part 3 having a diameter of about 50 mm, has proved suitable for adequate cooling of LED lamps with a dissipation of 6 to 10 watt.

Figure 2:
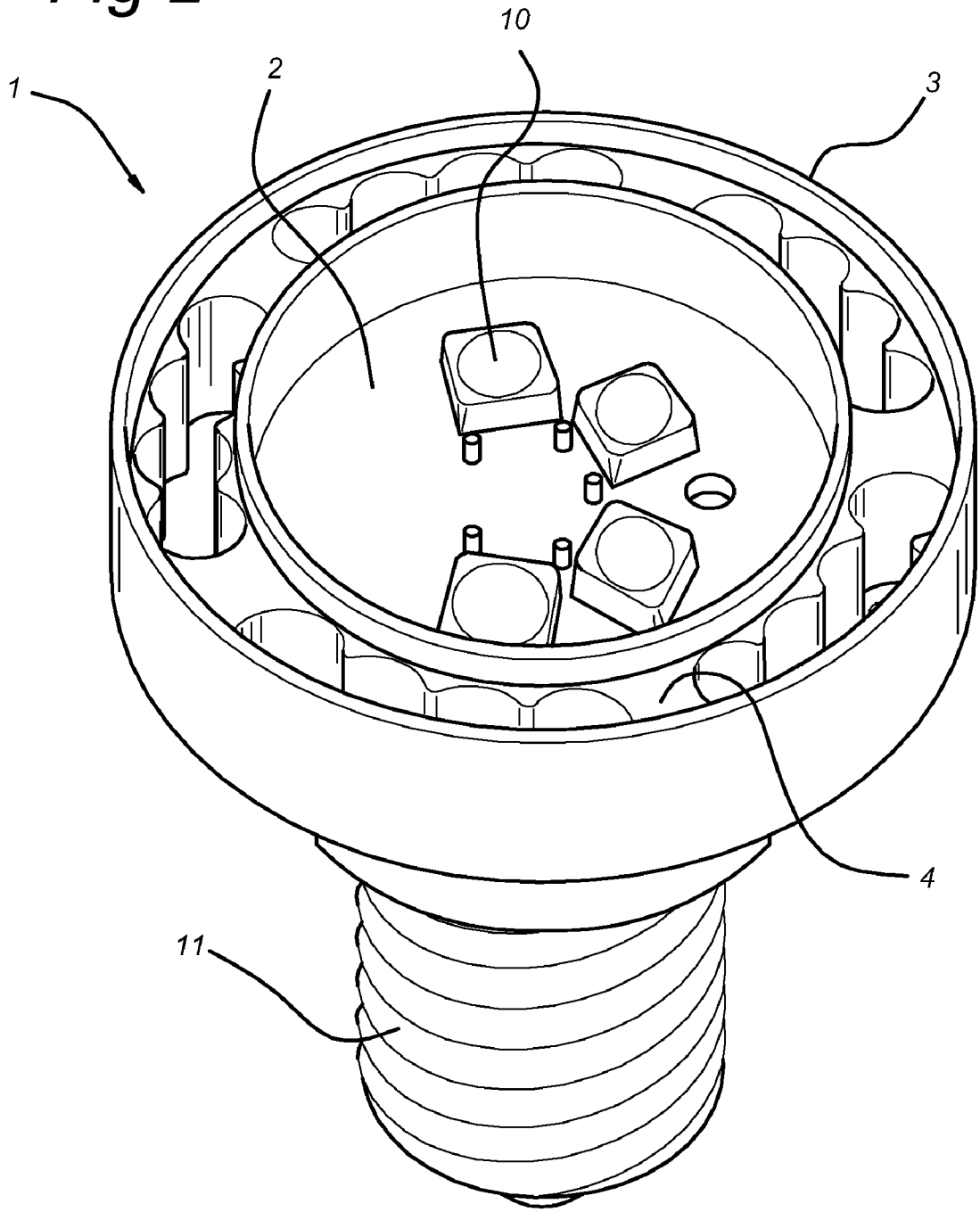
FIG. 2 shows a first embodiment of a lamp with a heat sink according to the invention.

FIG. 2 shows a first embodiment of a lamp with a heat sink according to the invention. Again a heat sink 1 is shown with an inner part 2, an outer part 3 and bridging elements 4. In contrast to the heat sink 1 in FIG. 1, the surface of the inner part 2 is somewhat recessed. Light elements 10, which have a fastening side and a light emission side, have been fitted on the surface. The heat sink 1 is joined to a lamp cap 11, in this case a lamp fitting such as is used for light bulbs. The heat sink 1 is therefore preferably equipped in such a way that it can be fixed to the lamp cap 11, for example by being provided with a screw thread or having dimensions such that it can be clamped round the lamp cap. Alternatively, a section of the inner part 2 can be somewhat recessed on the side of the lamp cap 11 so that the lamp cap 11 fits tightly into this recessed section of the inner part 2. The join can be made more stable by using an adhesive such as superglue.

Electronic components that are required for controlling the one or more light elements 10 correctly can be accommodated in the lamp cap 11. The inner part 2 can be provided with holes to enable electrical wiring for the one or more light elements 10 from the lamp cap 11.

A transparent protection plate, which galvanically shields the light elements 10 from the surroundings, can be placed on the light emission side of the light elements 10, to protect the one or more light elements 10.

Furthermore, the heat sink 1 is preferably made of one or more materials with low electrical conduction (high electrical insulation), so as to prevent the receiving of shocks when touched during use.

Figure 3:
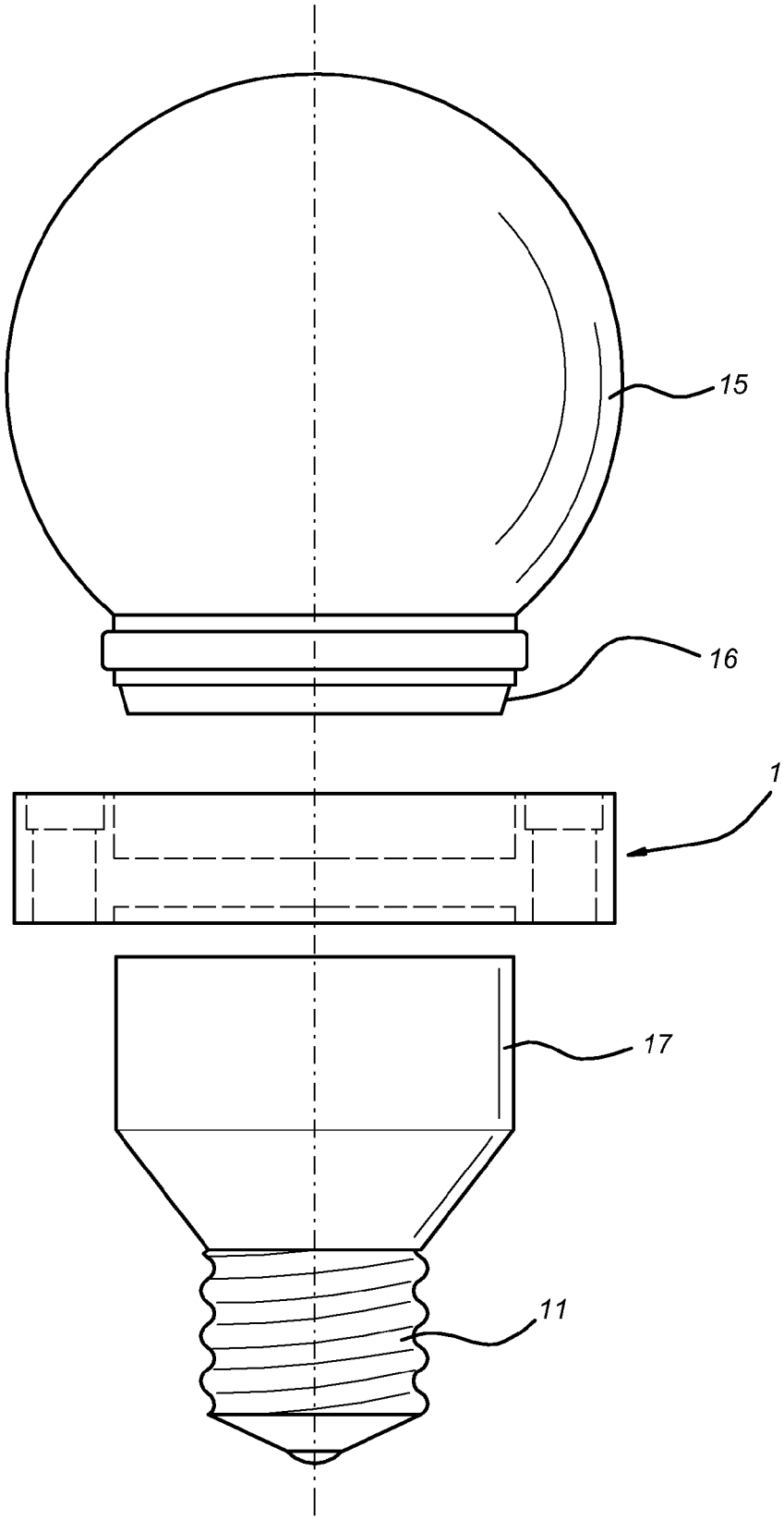
FIG. 3 shows a second embodiment of a lamp with a heat sink according to the invention.

FIG. 3 shows a second embodiment of a lamp with a heat sink according to the invention. In this figure, besides a heat sink 1 and a lamp cap 11, the lamp also comprises a lamp globe 15. Whereas a spotlight can be made with the lamp in FIG. 2, because of the presence of the lamp globe 15 the lamp in FIG. 3 is more suitable for producing diffuse light. By varying the characteristics of the lamp globe 15, for example a change in transparency in a wide or a narrow wavelength region, light can, moreover, be obtained with more/less diffusion, respectively, and a specific colour.

In FIG. 3 the three basic elements of the lamp are illustrated separately. For detachable fastening of the lamp globe 15 to the heat sink 1 the lamp globe 15 is provided with an external screw thread 16, while the heat sink 1 accordingly has an internal screw thread (not shown). In the embodiment shown in FIG. 3, the lamp cap 11 is provided with a raised edge 17 which can be clipped into the heat sink behind a ridge (not shown). Besides the screw and clip joints shown here, there are also other joining options for the connection between heat sink 1 and lamp cap 11, on the one hand, and the connection between the heat sink 1 and the lamp globe 15, on the other hand. The lamp globe 15 can, for instance, be provided with a so-called bayonet fitting, while the heat sink 1 has a suitable bayonet holder. The connection between the lamp cap 11 and the heat sink 1 can be brought about, for example, by providing the lamp cap 11 with one or more recesses, which are dimensioned in such a way that the one or more bridging elements 4 fit into these recesses.

It has already been described above that the heat sink 1 is preferably made of a material with good thermal conduction and poor electrical conduction. Besides, it is preferable if the material is easy to handle in machining processes during fabrication. A suitable material which meets all these requirements is anodised aluminium.

FIGS. 4*a-c* show a third embodiment of a lamp with a heat sink according to the invention. In this embodiment the heat sink 1 comprises an inner part 20 and an outer part 22. The outer part 22 is cylindrical with a variable diameter, for example in a shape as shown in FIG. 4*b*. The inner part 20, a possible embodiment of which is reproduced in FIG. 4*a*, is shaped in such a way that it can be clipped into the outer part 22. FIG. 4*c* presents a cross-section of a heat sink 1, where the inner part 20 is clipped into the outer part 22. The clipped position of the inner part 20 can be mode more stable by employing a support structure 27, for example a tube suitable for fastening into a lamp fitting. Inner part 20 can be provided with one or more holes 30 for taking the support structure 27, which can be provided for this purpose with one or more corresponding pegs 31.

The inner part 20 is suitable for accommodating at least one light element 26. The fastening side of the at least one light element 26 can be joined to the inner part 20 via a thermally conducting ceramic layer 25. Suitable materials for the thermally conducting ceramic layer 25 include aluminium oxide ($Al_2O_3$) and aluminium nitride (AlN). The ceramic layer 25 is particularly suitable for increasing the breakdown voltage between the at least one light element 26 and inner part 20, for example to a value of at least 7000 V. The ceramic layer 25 preferably has a thickness of 100-500 μm, the optimum thickness being partly dependent on the electric voltage used for the at least one light element 26 and the material chosen for the ceramic layer 25.

The inner part 20 can furthermore be provided with at least one trough-shaped, concentric structure 24. The trough-shaped, concentric structure 24 gives an increase in the radiation surface area of the inner part 20, as a result of which the heat emission in use can be increased.

For further cooling, the outer part 22 may be provided with one or more holes 29. Through the at least one hole, because of the difference in heat between the inner part 22, on the one hand, and the surrounding air, on the other hand, a heat flow can be created which brings about extra heat emission.

Both the inner part 20 and the outer part 22 can be manufactured from anodised aluminium. As previously described, this material has good thermal conduction and poor electrical conduction. As a result of this, the at least one light element 26 can be galvanically shielded from the inner part 20, multiple insulation being assured, even without employing a ceramic layer 25. It should be understood that even with the embodiment as shown in FIGS. 4*a-c* the lamp with the heat sink can be provided with a covering element, for example a lamp globe as shown in FIG. 3, which can be fitted in a way as previously described.

Extrusion can be employed to obtain a heat sink 1 wherein all the elements 2-4 are made of the same material and even in one piece too. With this technique a suitable material is heated, for example, in the case of aluminium, to a temperature of between 400-500° C., and pressed under pressure through an extrusion die. The result is an elongated object with a virtually constant cross-section, which can have a solid, hollow or virtually any desired pattern. Removing metal material at the ends can be obviated by employing so-called impact extrusion. A suitable basic structure for the heat sink 1 can be obtained by using a suitable die and subdividing the elongated object into discs of suitable size after extrusion. The die can also produce, as well as openings 5, openings in the inner part 2, which can be used for wiring for the at least one light element 10. In order to obtain the detailed embodiments as shown in FIGS. 1-3, the bade structures can be further machined with the aid of known machining techniques, such as milling and turning.

The above description describes only a number of possible embodiments of the present invention. It is easy to see that many alternative embodiments of the invention can be conceived, all of which fall within the scope of the invention. This is defined by the following claims.

The invention claimed is:

1. Heat sink for cooling at least one light element, the heat sink comprising:

a thermally conducting inner part suitable for accommodating the at least one light element;

a thermally conducting outer part that surrounds the inner part in at least one plane;

wherein the at least one light element is galvanically shielded from the thermally conducting inner part, wherein the inner part is clippable into the outer part, and wherein the outer part is a cylindrical structure with a variable diameter, the cylindrical surface of the outer part being provided with at least one hole.

2. Heat sink according to claim 1, wherein at least one of the inner part and outer part is made of anodised aluminium.

3. Heat sink according to claim 1, wherein the inner part comprises fastening means for fastening to a lamp cap.

4. Heat sink according to claim 1, wherein the inner part comprises second fastening means for detachable fastening to a lamp globe.

5. Heat sink according to claim 1, wherein the inner part comprises a disc with at least one concentric trough-shaped structure.

6. Lamp comprising:

a lamp cap for positioning the lamp and connecting the lamp to an electrical source;

at least one light element with a light emission side and a fastening side; and a heat sink according to claim 1, the fastening side of the at least one light element being connected to the inner part of the heat sink.

7. Lamp according to claim 6, wherein the at least one light element is a light-emitting diode.

8. Lamp according to claim 7, wherein the fastening side of the at least one light element is joined to the inner part (2; 20) of the heat sink (1) via a thermally conducting ceramic layer (25).

9. Lamp according to claim 8, wherein the thermally conducting ceramic layer has a thickness of 100-500 μm.

10. Lamp according to claim 8, wherein the thermally conducting ceramic layer comprises at least one ceramic material from the group of aluminium oxide and aluminium nitride.

11. Lamp according to claim 6, wherein the lamp furthermore comprises a transparent protective body which shields the at least one light element on the light emission side of the light element.

12. Lamp according to claim 6, characterised in that the lamp furthermore comprises a lamp globe situated on the light emission side of the at least one light element.

13. Heat sink according to claim 1, wherein the inner part and the outer part from a heat connection while being galvanically disconnected.

14. Heat sink according to claim 1, further comprising a thermally conducting ceramic layer for galvanically shielding the at least one light element from the inner part.

15. Heat sink according to claim 14, wherein the ceramic layer comprises at least one of aluminium oxide and aluminium nitride.

16. Heat sink according to claim 14, wherein the ceramic layer has a thickness of 100-500 μm.

* * * * *